US011771927B2

(12) United States Patent
Baek et al.

(10) Patent No.: US 11,771,927 B2
(45) Date of Patent: Oct. 3, 2023

(54) REBREATHING APPARATUS HAVING INHALED OXYGEN MIXING AND EXHALED CARBON DIOXIDE REMOVAL FUNCTIONS BY ELECTRONIC CONTROL

(71) Applicant: Farosystem Co., Ltd, Gyeongju-si (KR)

(72) Inventors: Hyang Mok Baek, Pohang-si (KR); Sang Yup Kwon, Ulsan (KR); Jun Ho Lee, Seoul (KR); Jung Han Baek, Ulsan (KR)

(73) Assignee: Daniel Co., Ltd.

( * ) Notice: Subject to any disclaimer, the term of this patent is extended or adjusted under 35 U.S.C. 154(b) by 636 days.

(21) Appl. No.: 16/697,848

(22) Filed: Nov. 27, 2019

(65) Prior Publication Data

US 2021/0128850 A1 May 6, 2021

(30) Foreign Application Priority Data

Oct. 30, 2019 (KR) ..... 10-2019-0136411

(51) Int. Cl.
*A62B 7/02* (2006.01)
*A62B 9/00* (2006.01)
*A62B 7/10* (2006.01)

(52) U.S. Cl.
CPC ..... *A62B 9/006* (2013.01); *A62B 7/02* (2013.01); *A62B 7/10* (2013.01)

(58) Field of Classification Search
CPC .. A62B 7/10; A62B 9/006; A62B 7/02; A62B 7/04; A61M 16/22; A61M 16/0891; B63C 11/24
See application file for complete search history.

(56) References Cited

U.S. PATENT DOCUMENTS 5,036,841 A * 8/1991 Hamilton ..... A62B 7/10 128/205.12
6,712,071 B1 * 3/2004 Parker ..... B63C 11/24 128/203.14

(Continued)

FOREIGN PATENT DOCUMENTS

CN 104324459 A * 2/2015
FR 2693117 A1 * 1/1994 ..... A62B 7/02

(Continued)

OTHER PUBLICATIONS

Decision to Grant a Patent issued by the Korean Intellectual Property Office (KIPO) dated Apr. 29, 2021 concerning the corresponding KR patent application 10-2019-0136411 (with English translation) (3 pages).

(Continued)

*Primary Examiner* — Bradley H Philips
(74) *Attorney, Agent, or Firm* — Harness, Dickey & Pierce, P.L.C.

(57) ABSTRACT

A rebreathing apparatus having inhaled oxygen mixing and exhaled carbon dioxide removal functions, enabling rebreathing by maintaining the amount of breathing oxygen by inhalation and removing carbon dioxide discharged by exhalation. The rebreathing apparatus includes a mask having one side to which an inhalation hose is connected and the other side to which an exhalation hose is connected; an exhaled breath storing container storing exhaled breath; a filter removing carbon dioxide; an inhaled breath storing container storing the air having passed through the filter; an oxygen storing container supplying oxygen to the inhalation storing container; a decompressor installed at an inlet of the oxygen storing container; an oxygen mixing module mixing the oxygen discharged through the oxygen supplying hose with the air; and a controller controlling operations of the (Continued)

exhaled breath storing container, the inhaled breath storing container, the oxygen storing container, the filter, and the oxygen mixing module.

5 Claims, 4 Drawing Sheets

(56) References Cited

U.S. PATENT DOCUMENTS

| | | | | |
|---|---|---|---|---|
| 2007/0163591 | A1* | 7/2007 | Ross | A62B 21/00 128/205.12 |
| 2009/0250062 | A1* | 10/2009 | Reynolds | B63C 11/22 128/205.24 |
| 2010/0313887 | A1* | 12/2010 | Sieber | B63C 11/32 128/204.22 |
| 2015/0283409 | A1* | 10/2015 | Buck | A62B 9/02 128/204.22 |
| 2017/0021202 | A1* | 1/2017 | Koch | A62B 7/10 |
| 2017/0072231 | A1* | 3/2017 | Carr | G08B 25/00 |
| 2017/0100610 | A1* | 4/2017 | Gurr | A62B 9/006 |
| 2022/0001218 | A1* | 1/2022 | Popov | A62B 9/003 |
| 2022/0126123 | A1* | 4/2022 | Lee | A62B 9/006 |

FOREIGN PATENT DOCUMENTS

| | | | | |
|---|---|---|---|---|
| JP | 2009527302 | A | 7/2009 | |
| KR | 10-0574787 | B1 | 5/2006 | |
| KR | 10-2006-0071061 | A | 6/2006 | |
| KR | 10-1549684 | B1 | 9/2015 | |
| KR | 20180113443 | * | 10/2018 | A62B 7/04 |
| KR | 20190115490 | A | 10/2019 | |

OTHER PUBLICATIONS

Office Action issued by the Japanese Patent Office dated Oct. 9, 2020 concerning the corresponding JP patent application 2019-214052 (with English translation) (9 pages).

Office Action issued by the Korean Intellectual Property Office (KIPO) dated Sep. 29, 2020 concerning the corresponding KR patent application 10-2019-0136411 (with English translation) (17 pages).

* cited by examiner

REBREATHING APPARATUS HAVING INHALED OXYGEN MIXING AND EXHALED CARBON DIOXIDE REMOVAL FUNCTIONS BY ELECTRONIC CONTROL

CROSS REFERENCE TO RELATED APPLICATION

The present application claims priority to Korean Patent Application No. 10-2019-0136411, filed Oct. 30, 2019, the entire content of which is incorporated herein for all purposes by this reference.

BACKGROUND OF THE INVENTION

Field of the Invention

The present disclosure relates to a rebreathing apparatus having inhaled oxygen mixing and exhaled carbon dioxide removal functions. More particularly, the present disclosure relates to a rebreathing apparatus enabling rebreathing by maintaining the amount of breathing oxygen by inhalation using an oxygen mixing module and removing carbon dioxide discharged by exhalation.

Description of the Related Art

Unless otherwise expressed in this specification, the contents described in this section are not related arts to the claims of the subject application. Also, inclusion of an art in this section does not recognize the art as a related art.

For a patient who suffers from respiratory arrest, respiratory failure, or difficulty with breathing, etc. due to lack of oxygen caused by a disease and/or a disaster accident at home or at the workplace, etc., it is necessary to supply an appropriate amount of oxygen to the patient within a golden time to thereby maintain the patient's life during the time before rescue workers arrive.

Disaster accidents generate heat, flames, toxic gases, etc., thus posing danger to humans. It is known that a person may asphyxiate due to toxic gases and smoke within 2 to 5 minutes after fire breaks out.

An air respirator has been provided so as to protect human life from this danger. The air respirators are worn by workers in industrial sites where dust, toxic gases, etc. are generated, or in oxygen deficient sites. Such air respirators are also worn by lifeguards (firefighters) at subways in which fire breaks out or in fire sites, etc., and are used to protect the lifeguards' faces and prevent inhalation of gases harmful to human bodies.

Korean Patent Application Publication No. 10-2006-0071061 discloses "An air respirator for emergency" including a mask covering a user's nose and mouth areas to block them off from the outside, and an air storage connected to the mask, wherein air supplied from an air supplier is stored in the air storage and the stored air is used for respiration.

However, in disastrous situations in which toxic gas is generated or in situations such as flooding in which oxygen is completely blocked, survival probability can be enhanced by increasing breath duration through a self-contained breathing apparatus (SCBA) enabling spontaneous breathing, rather than just simply resorting to an air supplier.

SCBA is an apparatus used in sites such as nuclear waste exposed areas, welding operation sites and fire disaster sites, etc., having toxic gases, so as to minimize life damage of the workers from dangers such as asphyxiation, etc.

SCBA is also referred to as CABA (compressed air breathing apparatus) or simply as BA (breathing apparatus). Here, BA, i.e., breathing apparatus, is not a tool to simply filter toxic substances in the air but an apparatus to supply air or oxygen to the workers so that the workers can regularly breathe. Supply of oxygen in a self-contained manner means that air is not supplied through a hose at a long distance but air is by itself created in the equipment. However, as the conventional air respirator is constructed completely in a mechanical structure, it is very heavy and has short use time. In addition, as the conventional air respirator is expensive, it is difficult to allow ordinary workers to use the respirators in workplaces where toxic gas is generated or workplaces where workers are exposed to toxic gas, etc.

Documents of Related Art (Patent Document 1) KR 10-2006-0071061 published on Jun. 26, 2006

(Patent Document 2) KR 10-1549684 registered on Aug. 27, 2015

(Patent Document 3) KR 10-0574787 registered on Apr. 21, 2006

SUMMARY OF THE INVENTION

The present disclosure has been made in order to solve the above-mentioned problems in the related art, and an aspect of the present disclosure is to provide a rebreathing apparatus for disasters, the rebreathing apparatus enabling spontaneous breathing in disastrous situations where toxic gases are generated, or in situations such as flooding in which oxygen is completely blocked, by mixing oxygen (the purity of which is 90% or higher) which can by itself supplied with breathing air discharged after self-purifying the breathing air, for re-use.

Also, another aspect of the present disclosure is to provide a rebreathing apparatus which can electronically control the entire rebreathing mechanism by use of a plurality of sensors by removing carbon dioxide discharged by exhalation from the air and mixing the air with oxygen supplied by use of an oxygen mixing module and supplying the mixed air.

In addition, the present disclosure is not limited to the technical problems as described above, and it is obvious that any other technical problem could be derived from the description of the invention as described below.

The rebreathing apparatus according to an exemplary embodiment of the present disclosure includes a mask having one side to which an inhalation hose is connected and the other side to which an exhalation hose is connected, the mask being configured to correspond to a user's face; an exhaled breath storing container in which exhaled breath discharged from the exhalation hose is stored; a filter configured to remove carbon dioxide discharged from the exhaled breath storing container; an inhaled breath storing container configured to store the air having passed through the filter, the inhaled breath storing container being connected to the inhalation hose of the mask; an oxygen storing container configured to supply oxygen through an oxygen supplying hose to the inhalation storing container; a decompressor installed at an inlet of the oxygen storing container, the decompressor being configured to block the oxygen of high pressure from being discharged; an oxygen mixing module configured to mix the oxygen discharged through the oxygen supplying hose with air and to supply the mixture to the inhaled breath storing container; and a controller configured to control operations of the exhaled breath storing container, the inhaled breath storing container, the oxygen storing container, the filter, and the oxygen mixing module.

According to a preferred feature of the present disclosure, the rebreathing apparatus further includes an inhaled breath blocking pad configured to block inhaled breath from flowing into the exhalation hose (13).

According to a preferred feature of the present disclosure, the rebreathing apparatus further includes an exhaled breath blocking pad configured to block exhaled breath from being divulged to the inhalation hose.

According to a preferred feature of the present disclosure, the mask includes a full-face mask covering a user's whole face or a half-face mask covering user's nose and mouth areas.

According to a preferred feature of the present disclosure, the rebreathing apparatus further includes a pressure sensor installed at the decompressor, and configured to detect a pressure of oxygen discharged from the oxygen storing container; an oxygen content sensor installed at the oxygen storing container, and configured to detect a remaining amount of oxygen; an oxygen concentration sensor installed at the inhaled breath storing container, and configured to detect a concentration of breathing oxygen; and a $CO_2$ concentration sensor installed at the inhaled breath storing container, and configured to detect a concentration of breathing $CO_2$.

According to a preferred feature of the present disclosure, the controller includes a power module configured to supply power by means of a battery or a charging device, and further includes a communication module configured to transmit state information of the pressure sensor, the oxygen content sensor, the oxygen concentration sensor, the $CO_2$ concentration sensor, and the power module to an external display device.

According to a preferred feature of the present disclosure, the controller is configured to operate the power module when a valve of the oxygen storing container is opened and a pressure of oxygen is sensed by the pressure sensor.

According to a preferred feature of the present disclosure, the controller performs: (A) a first step of inspecting the remaining amount of oxygen by the oxygen content sensor installed at the oxygen storing container; (B) a second step of checking an operation state of the communication module; (C) a third step of inspecting the concentration of breathing oxygen by the oxygen concentration sensor installed at the inhaled breath storing container; (D) a fourth step of inspecting the concentration of breathing $CO_2$ by the $CO_2$ concentration sensor installed at the inhaled breath storing container; and (E) a fifth step of inspecting remaining power of the battery of the power module.

According to a preferred feature of the present disclosure, in the first step, when the remaining amount of oxygen is equal to or greater than a first set value, the first step proceeds to the second step, and when the remaining amount of oxygen is less than the first set value, an alarm signal is generated on the display device through the communication module.

According to a preferred feature of the present disclosure, in the second step, when the communication module is operated within a second set value, the second step proceeds to the third step, and when the communication module is erroneously operated over the second set value, an alarm signal is generated on the display device through the communication module.

According to a preferred feature of the present disclosure, in the third step, when a breathing oxygen concentration ratio is equal to or greater than a third set value, the third step proceeds to the fourth step, and when the breathing oxygen concentration ratio is less than the third set value, an alarm signal is generated on the display device through the communication module.

According to a preferred feature of the present disclosure, in the fourth step, when a breathing $CO_2$ concentration ratio is equal to or less than a fourth set value, the fourth step proceeds to the fifth step, and when the breathing $CO_2$ concentration ratio exceeds the fourth set value at the fourth step, an alarm signal is generated on the display device through the communication module.

According to a preferred feature of the present disclosure, in the fifth step, when the remaining power of the battery is equal to or greater than a fifth set value, the fifth step proceeds to the first step, and when the remaining power of the battery is less than the fifth set value, an alarm signal is generated on the display device through the communication module.

According to a preferred feature of the present disclosure, the state information transmitted from the communication module is checked on a user's portable terminal.

According to an exemplary embodiment, the present disclosure is advantageous in that a user can be protected from contaminated external air through a mask, and the oxygen content more than in a general oxygen tank can be supplied for a long time, thus extending the breathing time which can lead to increasing the survival probability.

According to an exemplary embodiment, the present disclosure is also advantageous that through a system that can control and self-monitor state information of the rebreathing apparatus, information on working environment and working status can be effectively transmitted to the user.

According to an exemplary embodiment, the present disclosure is further advantageous that an alarm signal is autonomously transmitted to the user's portable terminal, etc. when any abnormality occurs in the state of the rebreathing apparatus, and thus state information of the apparatus can be more easily known.

The present disclosure is not limited to the effects as described above. It should be understood that any and all effects that may be construed from the configurations of the invention described in the detailed description or the claims of the present disclosure are included.

BRIEF DESCRIPTION OF THE DRAWINGS

The above and other objects, features, and other advantages of the present disclosure will be more clearly understood from the following detailed description when taken in conjunction with the accompanying drawings, in which.

DETAILED DESCRIPTION OF THE INVENTION

Hereinafter, a rebreathing apparatus in accordance with a preferred embodiment of the present disclosure will be described in respect of configuration, operation and operational effect with reference to the accompanying drawings. It should be understood that each element is omitted or schematically illustrated for the sake of convenience or clarity in the accompanying drawings, and the size of each element does not reflect the actual size thereof. Also, the same reference numbers denote the same elements throughout the specification, and reference numbers for the same elements may be omitted in the respective drawings.

Figure 1:
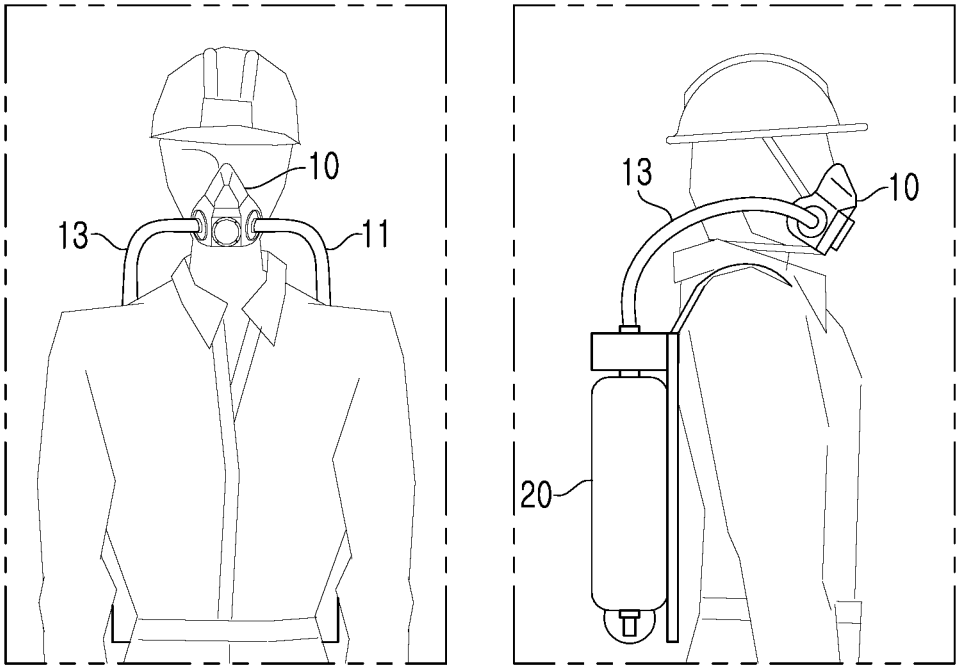
FIG. 1 is a view showing a use state of a rebreathing apparatus in accordance with an exemplary embodiment of the present disclosure.
Figure 2:
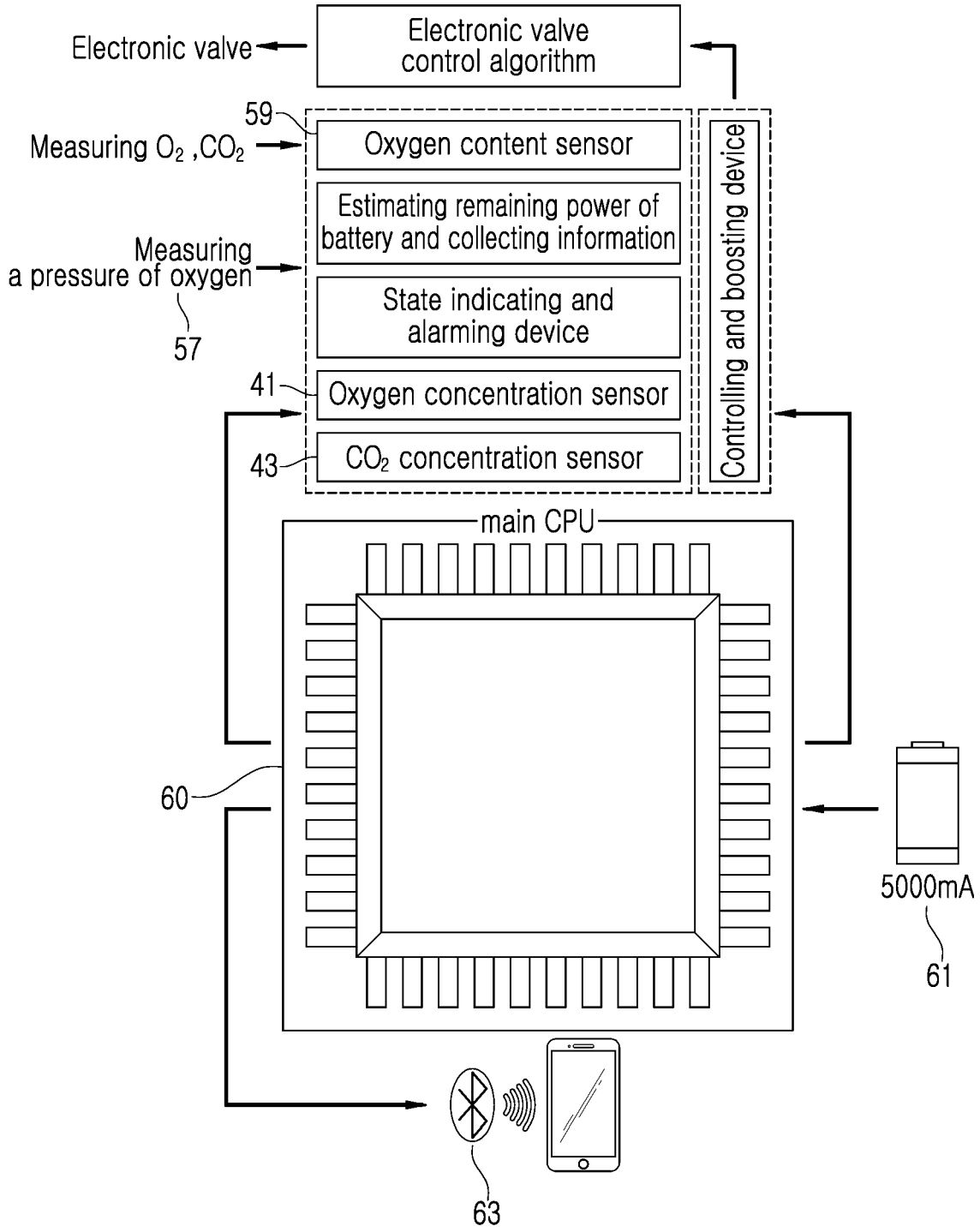
FIG. 2 is a block diagram of a controller of a rebreathing apparatus in accordance with an exemplary embodiment of the present disclosure.
Figure 3:
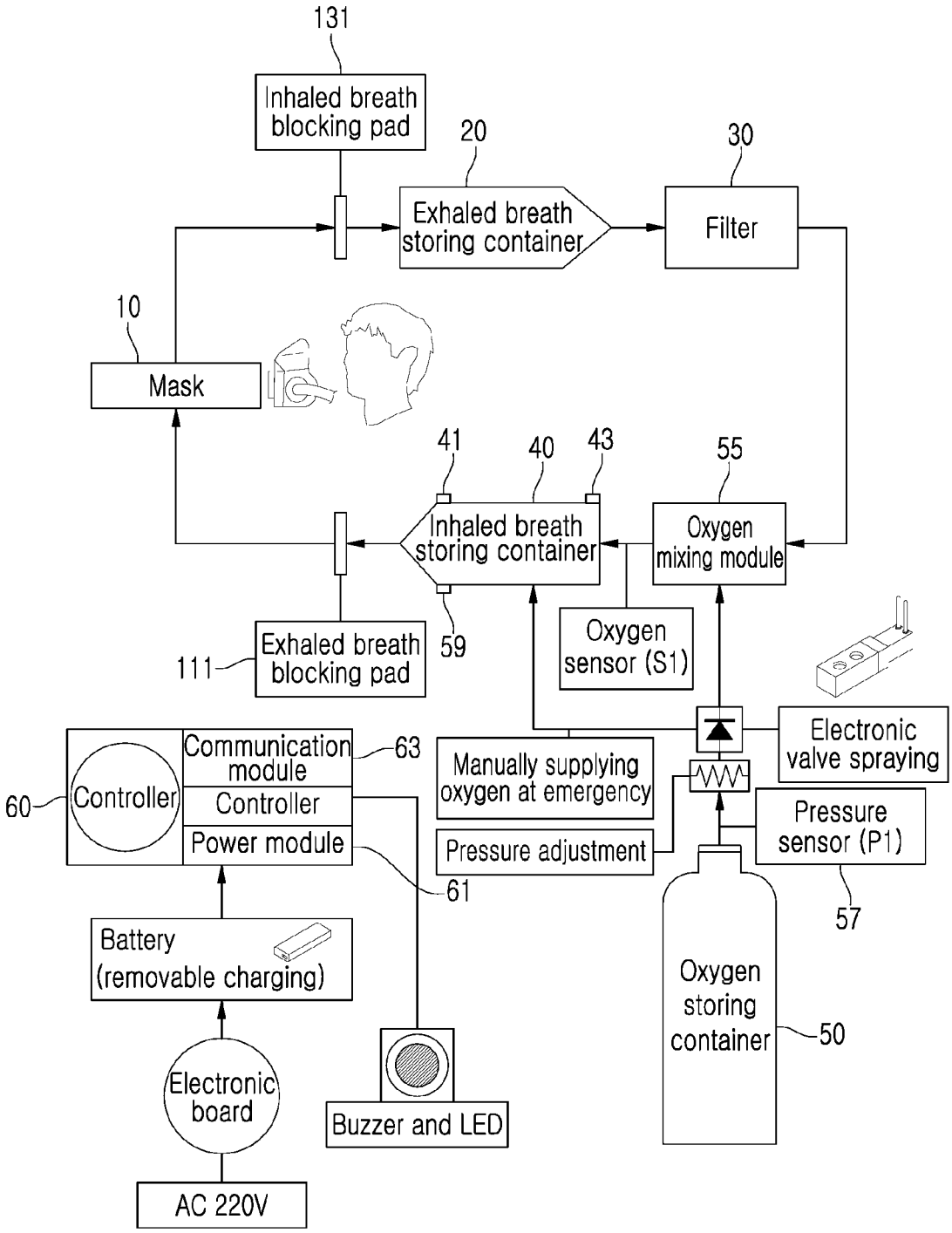
FIG. 3 is a view showing an operation state of a rebreathing apparatus in accordance with an exemplary embodiment of the present disclosure.

FIG. 1 is a view showing a use state of a rebreathing apparatus in accordance with an exemplary embodiment of the present disclosure and FIG. 3 is a view showing an operation state of a rebreathing apparatus in accordance with an exemplary embodiment of the present disclosure.

According to an exemplary embodiment of the present disclosure, a rebreathing apparatus is characterized in including: a mask 10 with one side to which an inhalation hose 11 is connected and the other side to which an exhalation hose 13 is connected, the mask 10 being configured to correspond to a user's face; an exhaled breath storing container 20 in which exhaled breath discharged from the exhalation hose 13 is stored; a filter 30 removing carbon dioxide discharged from the exhaled breath storing container 20; an inhaled breath storing container 40 in which the air having passed through the filter 30 is stored, the storing container 40 being connected to the inhalation hose 11 of the mask 10; an oxygen storing container 50 supplying oxygen through an oxygen supplying hose 51 to the inhaled breath storing container 40; a decompressor 53 installed at an inlet of the oxygen storing container 50, the decompressor 53 blocking oxygen of high pressure from being discharged; an oxygen mixing module 55 mixing the oxygen discharged through the oxygen supplying hose 51 with the air and suppling the mixture to the inhaled breath storing container 40; and a controller 60 controlling operations of the exhaled breath storing container 20, the inhaled breath storing container 40, the oxygen storing container 50, the filter 30, and the oxygen mixing module 55.

The mask is configured to allow a user to absorb oxygen by inhalation and to discharge carbon dioxide by exhalation. The inhalation hose 11 through which air containing oxygen is absorbed and the exhalation hose 13 through which carbon dioxide is discharged are connected to both ends of the mask 10. Here, a problem that inhaled breath and exhaled breath are mixed because the inhalation hose 11 and the exhalation hose 13 are interconnected via the mask occurs. In order to solve this problem, an exhaled breath blocking pad 111 blocking exhaled breath may be installed at one side of the inhalation hose 11, and an inhaled breath blocking pad 131 blocking inhaled breath may be installed at the exhalation hose 13.

According to a preferred feature of the present disclosure, the mask 10 may be configured as a full-face mask covering a user's whole face or a half-face mask covering the user's nose and mouth areas.

The mask 10 may be selectively used as a full-face mask or a half-face mask as appropriate depending upon the degree of the situation. Here, a mouthpiece including a positive pressure and negative pressure adjuster is installed at the mask. The positive pressure and negative pressure adjuster belongs to a module for removing $CO_2$ and moisture. In order to maintain a respiration pressure of 1 atmosphere at which the user can breathe comfortably, the positive pressure and negative pressure adjuster is operated to reduce the respiration pressure in case of positive pressure (larger than 1 atmosphere) and to increase the respiration pressure in case of negative pressure (lower than 1 atmosphere).

The rebreathing apparatus further includes an exhaled breath storing container 20 in which exhaled breath discharged from the exhalation hose 13 is stored, a filter 30 removing carbon dioxide discharged from the exhaled breath storing container 20, and an inhaled breath storing container 40 storing the air having passed through the filter 30, the inhaled breath storing container 40 being connected to the inhalation hose 11 of the mask 10.

The air containing carbon dioxide discharged to the exhaled breath storing container 20 then passes through the filter 30 interconnecting the exhaled breath storing container 20 and the inhaled breath storing container 40 and filtering carbon dioxide included in the exhaled breath, and the filtered air is transmitted to the inhaled breath storing container 40. It is preferable that the filter 30 is constructed of a carbon dioxide absorbing filter. As a propeller of the filter 30 is rotated in response to operation of a motor, this makes it possible to quickly move the air of the filter 30 to the inhaled breath containing container 40. A minutiae amount of carbon dioxide, nitrogen, etc. is contained in the air from which carbon dioxide flowing into the inhaled breath storing container 40 is filtered, and the filtered air is mixed with oxygen flowing in from the oxygen storing container 50 and the mixture is used for rebreathing.

The rebreathing apparatus may further include an oxygen storing container 50 supplying oxygen through an oxygen supplying hose 51 to the inhaled breath storing container 40, a decompressor 53 installed at an inlet of the oxygen storing container 50, blocking oxygen of high pressure from being discharged, and an oxygen mixing module 55 mixing the oxygen discharged through the oxygen supplying hose 51 with the air and suppling the mixture to the inhaled breath storing container 40.

The decompressor 53 is configured to adjust oxygen of high pressure coming from the oxygen storing container 50 in a proper amount and transmit the oxygen to the inhaled breath storing container 40. As an exemplary embodiment, the decompressor 53 depressurizes a gas discharged to the oxygen storing container 50 by 7.5 bars and then discharges the depressurized gas. The decompressor 53 may be configured with a pressure sensor 57 detecting a pressure of oxygen discharged, a storing container safety valve installed at an outlet of the oxygen storing container 50, adjusting the amount of oxygen discharged, and a pressure gauge indicating a pressure of the oxygen storing container 50. In this regard, the oxygen depressurized through the decompressor 53 is mixed with air having passed through the filter 30 in the oxygen mixing module 55 and can be supplied in a state that about 22% or more of the oxygen is maintained.

According to a preferred feature of the present disclosure, the rebreathing apparatus may further include an oxygen content sensor 59 installed at the oxygen storing container 50, detecting the remaining amount of oxygen, an oxygen concentration sensor 41 installed at the inhaled breath storing container 40, detecting a concentration of breathing oxygen, and a $CO_2$ concentration sensor 43 installed at the inhaled breath storing container 40, detecting a concentration of breathing $CO_2$.

The oxygen content sensor 59 is a sensor to check an amount of oxygen remaining in the oxygen storing container 50, that is, the remaining amount of oxygen, and inform the user of the remaining amount of oxygen. The oxygen concentration sensor 41 and the $CO_2$ concentration sensor 43 are both sensors installed at the inhaled breath storing container 40, to check the amounts of oxygen and carbon dioxide in the air prior to breathing through the inhalation hose 11 and informing the user of the amounts.

Also, the rebreathing apparatus includes a controller 60 controlling operations of the exhaled breath storing container 20, the inhaled breath storing container 40, the oxygen storing container 50, the filter 30, and the oxygen mixing module 55.

According to a preferred feature of the present disclosure, the controller 60 includes a power module 61 supplying power by means of a battery or a charging device, and may further include a communication module 63 transmitting state information of the pressure sensor 57, the oxygen content sensor 59, the oxygen concentration sensor 41, the $CO_2$ concentration sensor 43 and the power module 61 to an external display device.

The power module 61 may supply power through a charging device, or may be formed of a removable charging device such as a battery, etc. The communication module 63 functions to receive all operation signals from the controller 60 and transmit the signals to the external display device. The display device may be formed of a buzzer or a light emitting diode (LED). When an alarm signal from the controller 60 is received by the display device, a user can recognize the alarm signal visually or acoustically by the LED or the buzzer.

According to a preferred feature of the present disclosure, the state information transmitted from the communication module 63 can be checked at the user's portable terminal.

The user can ascertain a danger signal, etc. from the communication module 63 through the display device and also the user's portable terminal by use of telecommunication functions such as Bluetooth, thereby increasing convenience and easiness in use.

Hereinbelow, the entire operation mechanism of the rebreathing apparatus will be described in terms of the controller 60.

Figure 4:
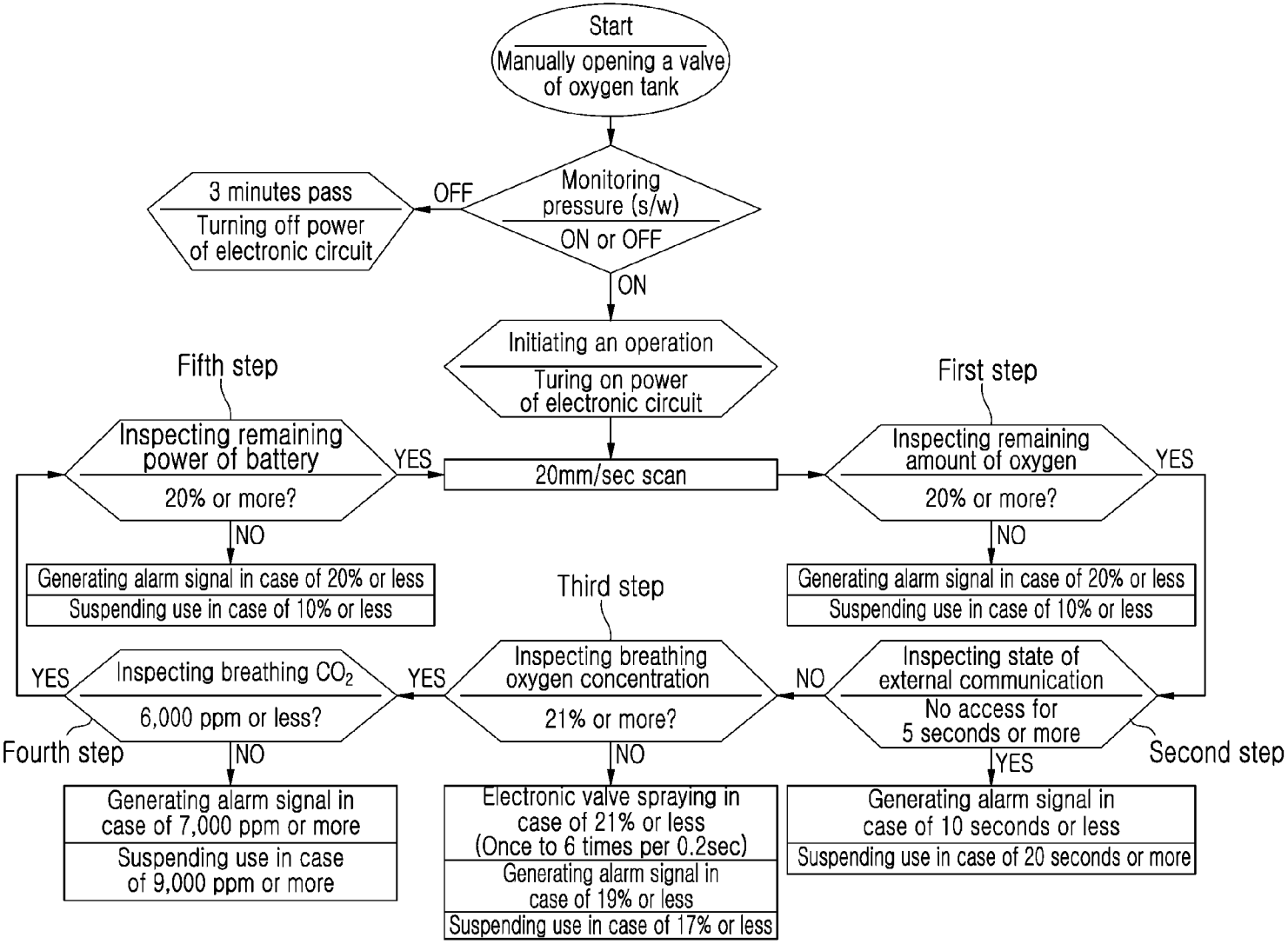
FIG. 4 is a flow chart showing data processing by a controller of a rebreathing apparatus in accordance with an exemplary embodiment of the present disclosure.

FIG. 4 is a flow chart showing data processing by a controller of a rebreathing apparatus in accordance with an exemplary embodiment of the present disclosure.

The controller 60 is characterized in that when a valve of the oxygen storing container 50 is opened and a pressure of oxygen is detected by the pressure sensor 57, the controller 60 operates the power module 61.

First, in order to use the rebreathing apparatus according to the present disclosure, when the valve of the oxygen storing container 50 is opened, oxygen discharged through the pressure sensor 57 is detected. When the oxygen is detected, the controller 60 operates an electronic circuit, whereby the rebreathing apparatus is fully operated. When the oxygen is not detected for 3 minutes or more, the controller 60 cuts off power of the electronic circuit, thereby suspending use of the rebreathing apparatus.

According to an exemplary embodiment of the present disclosure, as shown in FIG. 4, the controller 60 performs (A) a first step of inspecting the remaining amount of oxygen by the oxygen content sensor 59 installed at the oxygen storing container 50, (B) a second step of checking an operation state of the communication module (63), (C) a third step of inspecting a concentration of breathing oxygen by the oxygen concentration sensor 41 installed at the inhaled breath storing container 40, (D) a fourth step of inspecting a concentration of breathing $CO_2$ by the $CO_2$ concentration sensor 43 installed at the inhaled breath storing container 40, and (E) a fifth step of inspecting the remaining power of battery of the power module 61.

Here, where the remaining amount of oxygen is equal to or greater than a first set value, the first step proceeds to the second step. Where the remaining amount of oxygen is less than the first set value, an alarm signal is generated on the display device through the communication module 63.

As an exemplary embodiment in this regard, the first set value is supposed to be a state that as an amount of oxygen detected by the oxygen content sensor 59 installed at the oxygen storing container 50, 20% of oxygen remains as compared with the full state of oxygen. Where the remaining amount of oxygen is 20% or more, the first step proceeds to the second step, and where the remaining amount of oxygen is equal to or greater than 10% and less than 20%, an alarm signal is generated on the display device through the communication module 63.

Accordingly, when the remaining amount of oxygen is 20%, the second step proceeds. When the remaining amount of oxygen is less than 20%, a danger signal is transmitted to an external display device or a portable terminal through the communication module 63. When the remaining amount of oxygen is less than 10%, it is advisable for the user to suspend use of the rebreathing apparatus.

Next, where the communication module 63 is operated within a second set value, the second step proceeds to the third step, and where the communication module 63 is erroneously operated over the second set value, an alarm signal is generated on the display device through the communication module 63.

As an exemplary embodiment in this regard, the second set value is supposed to be 5 seconds, the time during which a sensor connected to the controller 60 detects a signal and transmits the signal through the communication module 63. The second step proceeds to the third step where the communication module operates within the 5 seconds. However, when the communication module 63 erroneously operates for 10 seconds or more, an alarm signal is generated on the display device through the communication module 63.

Accordingly, when the signal transmission time is delayed to 10 seconds or more, the communication module 63 senses that there is a problem in the communication function and sends a danger signal. When the signal transmission time is delayed for 20 seconds or more, use of the rebreathing apparatus should be suspended so as to any defect in the rebreathing apparatus.

Next, the third step proceeds to the fourth step where the breathing oxygen concentration ratio is equal to or greater than a third set value. At the third step, where the breathing oxygen concentration ratio is less than the third set value, an alarm signal is generated on the display device through the communication module 63.

As an exemplary embodiment in this regard, the third set value is supposed to be 21% of the oxygen detected by the oxygen concentration sensor 41 installed at the inhaled breath storing container 40 to check the amount of oxygen in the air breathed by the user through the inhalation hose 11, as compared with the whole air. The third step proceeds to the fourth step where the breathing oxygen concentration ratio is equal to or greater than 21%. Where the breathing oxygen concentration ratio is between 19% and 21%, oxygen is supplied to the inhaled breath storing container 40 from the oxygen mixing module once to six times per 0.2 sec. Where the breathing oxygen concentration ratio is less than 19%, an alarm signal is generated on the display device through the communication module 63.

Here, where the oxygen concentration ratio is between 19% and 21%, the controller 60 controls the oxygen mixing module 55 so as to increase the amount of oxygen and then supply the oxygen to the inhaled breath containing container 40. As an exemplary embodiment in this regard, oxygen can be supplied from once to six times per 0.2 sec (differently applicable depending upon the shortage in the amount of oxygen). Where the oxygen concentration ratio is less than 19%, an alarm signal can be generated, and where the oxygen concentration ratio drops to be less than 17%, use of the rebreathing apparatus should be suspended.

Next, the fourth step proceeds to the fifth step where the $CO_2$ concentration is equal to or less than a fourth set value. Where the $CO_2$ concentration exceeds the fourth set value, an alarm signal is generated on the display device through the communication module 63.

As an exemplary embodiment in this regard, the fourth set value is supposed to be 6000 ppm as the amount of carbon dioxide included in the inhaled breath storing container 40. The fifth step proceeds where the $CO_2$ concentration is equal to or less than 6000 ppm. Where the $CO_2$ concentration is equal to or greater than 7000 ppm, an alarm signal is generated on the display device through the communication module 63.

Accordingly, where the $CO_2$ concentration is equal to or greater than 7000 ppm, an alarm signal is generated, and where the $CO_2$ concentration is equal to or greater than 9000 ppm, use of the rebreathing apparatus should be suspended.

Last, where the remaining power of battery of the power module 61 is equal to or greater than a fifth set value, the fifth step proceeds to the first step. Where the remaining power of battery of the power module 61 is less than the fifth set value, an alarm signal is generated on the display device through the communication module 63.

As an exemplary embodiment in this regard, the fifth set value is supposed to be 20% of the battery as compared with the fully charged state of the battery. The fifth step proceeds to the first step where the remaining power of the battery of the power module is equal to or greater than 20%. Where the remaining power of battery of the power module is less than 20%, an alarm signal is generated on the display device through the communication module.

Accordingly, when a sufficient amount of battery to be used remains, the rebreathing apparatus goes back to the first step and repeats the steps as described above. When the remaining power of the battery is insufficient, an alarm signal is generated.

Although preferred embodiments of the present disclosure have been described with reference to the accompanying drawings, the embodiments described in the specification and the configurations illustrated in the drawings are merely examples and do not exhaustively present the technical spirit of the present disclosure. Accordingly, it should be appreciated that there may be various equivalents and modifications that can replace the embodiments and the configurations at the time at which the present application is filed. Therefore, preferred embodiments of the present disclosure have been described for illustrative purposes, and should not be construed as being restrictive. The scope of the present disclosure is defined by the accompanying claims rather than the description which is presented above. Moreover, the present disclosure is intended to cover not only the exemplary embodiments, but also various alternatives, modifications, equivalents and other embodiments that may be included within the spirit and scope of the present disclosure as defined by the appended claims.

What is claimed is:

1. A rebreathing apparatus comprising:

a mask having one side to which an inhalation hose is connected and the other side to which an exhalation hose is connected, the mask being configured to correspond to a user's face;

an exhaled breath storing container in which exhaled breath discharged from the exhalation hose is stored;

a filter configured to remove carbon dioxide discharged from the exhaled breath storing container and to form a filtered air;

an inhaled breath storing container configured to store the filtered air having passed through the filter, the inhaled breath storing container being connected to the inhalation hose of the mask;

an oxygen storing container configured to supply oxygen through an oxygen supplying hose to the inhaled breath storing container;

a decompressor installed at an inlet of the oxygen storing container, the decompressor being configured to block the oxygen of high pressure from being discharged;

an oxygen mixing module configured to mix the oxygen discharged through the oxygen supplying hose with the filtered air and form a mixture, and to supply the mixture to the inhaled breath storing container;

a controller configured to control operations of the exhaled breath storing container, the inhaled breath storing container, the oxygen storing container, the filter, and the oxygen mixing module;

a pressure sensor installed at the decompressor, and configured to detect a pressure of oxygen discharged from the oxygen storing container;

an oxygen content sensor installed at the oxygen storing container, and configured to detect a remaining amount of oxygen;

an oxygen concentration sensor installed at the inhaled breath storing container, and configured to detect a concentration of breathing oxygen; and a $CO_2$ concentration sensor installed at the inhaled breath storing container, and configured to detect a concentration of breathing $CO_2$, wherein the controller comprises a power module configured to supply power by means of a battery or a charging device, and further comprises a communication module configured to transmit state information of the pressure sensor, the oxygen content sensor, the oxygen concentration sensor, the $CO_2$ concentration sensor, and the power module to an external display device;

wherein the controller is configured to operate the power module when a valve of the oxygen storing container is opened and a pressure of oxygen is sensed by the pressure sensor;

wherein the controller is configured to:

inspect the remaining amount of oxygen by the oxygen content sensor installed at the oxygen storing container;

check an operation state of the communication module;

inspect the concentration of breathing oxygen by the oxygen concentration sensor installed at the inhaled breath storing container;

inspect the concentration of breathing $CO_2$ by the $CO_2$ concentration sensor installed at the inhaled breath storing container; and inspect remaining power of the battery of the power module.

2. The rebreathing apparatus of claim 1, further comprising an inhaled breath blocking pad configured to block inhaled breath from flowing into the exhalation hose.

3. The rebreathing apparatus of claim 1, further comprising an exhaled breath blocking pad configured to block exhaled breath from being divulged to the inhalation hose.

4. The rebreathing apparatus of claim 1, wherein the mask comprises a full-face mask covering a user's whole face or a half-face mask covering user's nose and mouth areas.

5. The rebreathing apparatus of claim 1, wherein the state information transmitted from the communication module is checked on a user's portable terminal.

* * * * *